US005245983A

United States Patent [19]

Krieger

[11] Patent Number: 5,245,983

[45] Date of Patent: Sep. 21, 1993

[54] GRATE BAR AND GRATE FOR COMBUSTION PLANTS

[75] Inventor: Friedrich Krieger, Würzburg, Fed. Rep. of Germany

[73] Assignee: Noell K+K Abfalltechnik GmbH, Neuss, Fed. Rep. of Germany

[21] Appl. No.: 837,024

[22] Filed: Feb. 14, 1992

[30] Foreign Application Priority Data

Feb. 18, 1991 [DE] Fed. Rep. of Germany ..... 4105330

[51] Int. Cl.[5] ..... F23H 1/02

[52] U.S. Cl. ..... 126/163 R; 110/298; 110/281; 110/300; 126/174; 126/167

[58] Field of Search ..... 126/163 R, 163 A, 167, 126/152 B, 174, 175; 110/298, 299, 300, 281, 282, 327, 328, 101 R

[56] References Cited

U.S. PATENT DOCUMENTS

| | | | |
|---|---|---|---|
| 2,745,364 | 5/1956 | Martin | 110/298 |
| 3,508,535 | 4/1970 | Martin et al. | 110/298 X |
| 4,463,688 | 8/1984 | Andreoli | 110/298 |
| 4,719,900 | 1/1988 | Martin | 126/163 R |

FOREIGN PATENT DOCUMENTS

| | | |
|---|---|---|
| 0170803A1 | 2/1986 | European Pat. Off. . |
| 0205658B1 | 12/1986 | European Pat. Off. . |
| 3313615A1 | 11/1983 | Fed. Rep. of Germany . |
| 3813441C2 | 11/1988 | Fed. Rep. of Germany . |

*Primary Examiner*—Larry Jones

*Attorney, Agent, or Firm*—Cohen, Pontani, Lieberman, Pavane

[57] ABSTRACT

A grate bar support for use in combustion furnaces, particularly rubbish incinerators, has a hollow-box shaped member having a trapezoidal cross-section along a longitudinal direction and trapezoidal cross-section along a direction transverse to the longitudinal direction, a front and a rear end and a nozzle shaped air outlet opening located at the front end of the hollow box shaped member. A grate is formed by a plurality of overlapping alternately stationary and movable rows of grate bars having a stroke which corresponds to the distance two adjacent rows of grate bars are offset with respect to each other. Preferably, the grate bar supports are arcuately shaped so as to provide a tight grate surface in both cold and hot operating conditions.

9 Claims, 3 Drawing Sheets

GRATE BAR AND GRATE FOR COMBUSTION PLANTS

FIELD OF THE INVENTION

The present invention relates to a grate bar for use in combustion furnaces, such as rubbish incinerators, and, particularly, to hollow box-shaped grate bars having a trapezoidal contour and angled air nozzles.

BACKGROUND OF THE INVENTION

A grate for use in refuse combustion furnaces is customarily formed by rows of grate bars lying one behind the other and extending transverse to the direction of transport of the material being burned. These grate bars are subjected to considerably higher thermal and mechanical loads than grate bars used in power plants fueled by fossil fuel, since the materials burned in these combustion furnaces, vary considerably, in size, weight, calorific power, burning behavior and the like. The life of a grate bar should be as long and constant as possible for reasons of repair and overall availability of the furnace.

In a refuse combustion furnace, there are a myriad of different operational requirements, which are attempted to be satisfied, by varying the shape of the grate bars, and by utilizing grate bars of different materials.

A hollow box-shaped bipartite grate bar having air fed conduits on its rear and outlet openings on its surface is described in European Patent B1-0 205 658. Grate bars of this type produce a constant minimum air pressure in order to prevent the material being burned from penetrating into the grate bars. To date, however, no attention has been paid to the problem caused by melting non-ferrous metals and small high density steel scraps.

A grate bar in accordance with European Patent A1 0 170 803 comprises a support part and a head part which is flanged to the front of the grate bar and which is made of a material having great thermal resistance. During oxidation of the materials being burned, the grate bars receive part of the air from the bottom of the grate and, expel the air from the head part of each grate bar through an air outlet opening. Relative to the bottom of the grate there is a vacuum within the combustion chamber of the furance. The grate bar, which is otherwise open at the bottom, is divided by a rib at the center for reasons of stability and conduction of air. However, the above-described grate bar has certain defects. Molten, non-ferrous metals and small parts of steel scrap can be trapped in the space between the support part and the head part of the grate bar. Because the grate bar supports are disposed on the bottom of the grate bars, and because of the special shape of the head part of the grate bars, the movable rows of grate bars cannot, under these circumstances, be fully moved over the top surfaces of the adjacent rows of grate bars. Moreover, the air cooling of the bars is not constant due to variable inflow cross sections, as a result of the movement of the grate bars.

German Patent A1-33 13 615, discloses grate bars which have, at their head part, an outlet opening which permits the emergence of a stream of air at an angle which extends beyond the horizontal plane of the grate as well as beyond the head of the adjacent row of grate bars. The grate bar is otherwise open at the bottom and therefore does not permit a constant air cooling of the grate bars.

The top surfaces of the grate bars are arranged in a step-wise manner and the stroke of each row of grate bars is limited to about one-half of the free top surface of the grate bars.

German Patent A1 38 13 441, discloses a grate bar which is configured as a double layer construction for admitting air in two planes, and consequently, with two planes permitting the air to exit at the protruding head part of the grate bar. The front surface of the lower grate bar above the air outlet plane of the upper grate bar can never be cleared from any material including material to be burned, non-ferrous metals and steel scrap. Thus, such grate bars can only be used effectively on oblique grates and not on horizontal grates. No consideration has been given to the problem of melting non-ferrous metal.

SUMMARY OF THE INVENTION

An object of the present invention is to create a grate having grate bars which are thermally resistant, and prevent the underived emergence of air between the grate bars. Another object of the present invention is to have the tightest possible surface fit between the grate bars in both hot and cold conditions so that the grate bars are not susceptible to failure by the flow of non-ferrous metals or by small pieces of steel scrap. Yet, another object of the present invention is to permit the largest possible offset with respect to the adjacent row of grate bars so as to permit complete clearing of the rows of grate bars. The term offset refers to the distance by which a preferably movable row of grate bars is overlapping a preferably stationary row of grate bars.

The grate bar in accordance with the present invention has a hollow box-like trapezoidal cross section in both the longitudinal and transverse axes and includes an air inlet opening at the rear of the grate for introducing an air and air outlet opening at the front thereof. Furthermore, the grate bar can be provided with one or more ribs extending along the longitudinal direction which divide the hollow box-shaped bar on the inside. Additionally, the grate bar can be configured to include a front part which is arranged below the surface upon which the material being burned lies and which can be replaced when it becomes worn.

A significant advantage of the grate bar of the present invention lies in its trapezoidal shape, in particular along its longitudinal axis, which is the result of the bevelling of both the front and rear ends of the grate bar. The drive point is located on the rear, bottom side of the bar, opposite the rear end point of the top surface of the grate bar and the lower edge of the front part of the grate bar will still remain in contact with the upper or top surface of the preceding grate bar so that consecutive rows of grate bars still overlap each other at all times. This arrangement makes it possible to impart a stroke which extends the grate bar to more than two-thirds of its entire length. Nevertheless, the tip of the head part which lies on the preceding row of grate bars can completely clear the material to be burned from the grate bar lying in front of it. Upon the backward movement of the grate bar, its surface is cleared by the grate bar lying above it. Due to the sizable length of the stroke, the advancement of burning material is improved and the frictional wear on the grate bars is reduced.

The oxidation and the turning around or tumbling movement of the material being burned is aided by the air outlet nozzle. The air outlet nozzle and the corresponding stream of air are directed downward with respect to the horizontal design plane of the grate. Even when the bottom air flow is cut off or reduced, the penetration of the material being burned such as liquid non-ferrous metal or the like into the nozzle is impossible as a result of positioning the nozzle approximately in the center of the front surface of the grate bar. The stream of air entering the rear of the grate bar is directed towards the head part by the hollow box-shape and one or more inner ribs of the grate bar. Consequently, the grate is optimally cooled, especially when the inflow and outflow cross sections of the grate bar remain constant as the bottom air passes therethrough.

For manufacturing reasons or weight considerations in facilitating the installation of heavy grate bars, I-shaped or U-shaped cast sections can be employed to form a hollow box-like grate bar in accordance with the present invention.

The grate bar of the present invention has a trapezoidal cross section along the transverse direction while in the cold condition, so that the top or upper surface on which the material to be burned lies, is narrower than that of the bottom surface. However, at operating temperatures, the grate bar expands more on the top surface which is heated by the burning material than on the bottom side which receives a stream of cooling bottom air. Under operating temperature, the side surfaces of the adjacent grate bars expand so as to cause the side surfaces to lie parallel to each other. Thus, tight joints between the adjacent bars are established. Moreover, because under actual operating temperatures the head part of the grate bar is hotter than the rear part of the grate bar, the head part of the grate bar is also made correspondingly narrower than the rear part of the grate bar. Consequently, a grate bar is obtained which is tight in both the hot and cold conditions.

In order to prevent the grate bars from vertically rising during operation, as a result of having material to be burned wedged between two adjacent rows of grate bars, the grate bar support is configured in an arcuate shape so that the surface of the grate is trough-shaped, and remains trough-shaped during operation. The arcuate formation of the grate bar support is achieved by configuring the grate bars so as to have a trapezoidal cross section along the transverse direction while tapering the grate bars towards the head part thereof.

If the grate surface is required to be flat during the operation of the furnace, the height of the arc of the grate bar support can be selected to be correspondingly smaller.

It is important that the entire surface of the grate bar which can be cleaned or cleared by the reciprocating movement of and adjacent overlapping grate bar be as flat as possible so that no material to be burned will remain in a recess in the surface. A flat clearable surface permits the preceding row of grate bars to be cleared completely of material to be burned, as the grate bars are displaced with respect to each other. In order to preclude melting non-ferrous metal or small pieces of steel scrap from depositing in recesses in the surface of the grate, the replaceable head part of the grate bar is placed in a form-locked or form-fitted manner (mechanical interference fit) below the surface of the grate bar. The head part of the grate bar can be connected to the upper part of the hollow-box shaped grate bar by, for instance, pins. In this case, the insertable head part is made narrower than the grate bar so that an air outlet nozzle results between the adjacent bars. As an alternative embodiment, several head parts can be associated with one grate bar, so as to form between each other, as a recess, a common air nozzle.

BRIEF DESCRIPTION OF THE DRAWINGS

The present invention is described in more detail by way of example with reference to the accompanying drawings, in which.

DETAILED DESCRIPTION OF THE PRESENTLY PREFERRED EMBODIMENTS

Figure 1:
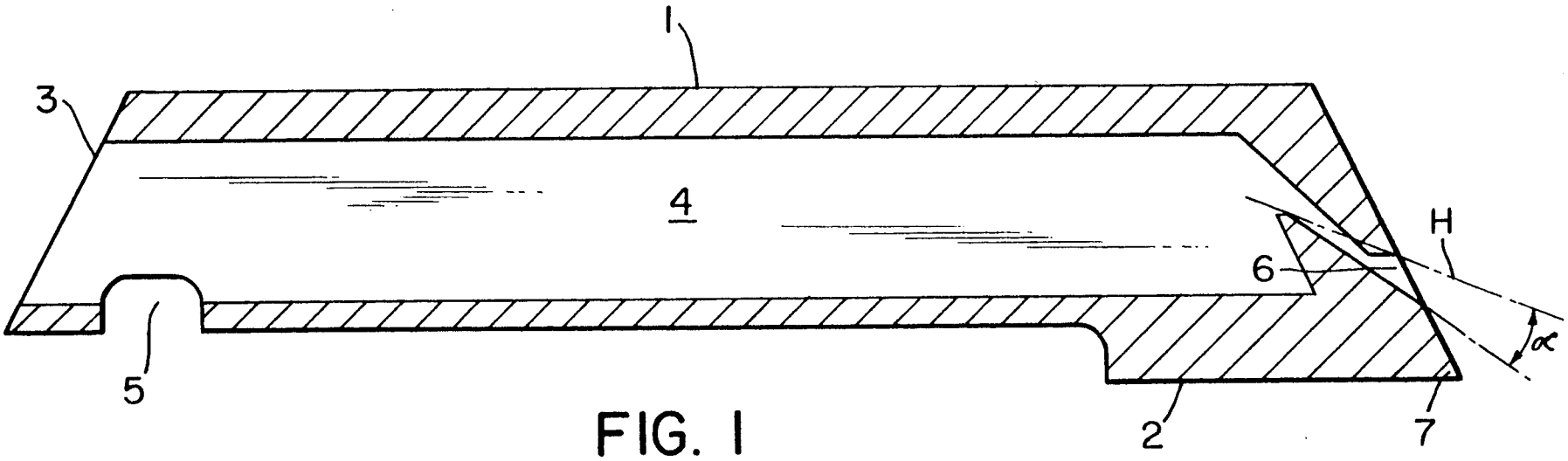
FIG. 1 is a longitudinal sectional view of a grate bar of the present invention.

The grate bar schematically shown in FIG. 1 has a surface 1 on which material to be burned is disposed and a bottom side 2 which at least in part rests on a row of preceding grate bars. A central rib 4 divides the grate bar in the longitudinal direction into two chambers, each of which can be fed with air through an open rear side 3 through which the air is supplied air to the grate as so-called bottom air. The air stream flows through the hollow-box and emerges at slot nozzle 6. This nozzle 6 is located on the front side of the grate bar above the front edge 7. Upon each stroke, the front edge 7 moves the burning material away from the preceding row of grate bars and thus assures the advancement of burning material and produces an additional raking effect on the material being burned. The horizontal plane H of the grate which is shown in FIG. 1 illustrates that the stream of air is directed at an angle $\alpha$ away from the horizontal plane and into the material being burned. Experiments have shown that such a direction of a stream of air leads to an optimal burning of the material. Preferably, the cross sections of the air feed and the cross sections of the air outlet always remain the same size regardless of the stroke which is transmitted by a grate bar support (not shown) or by a driver to the grate-bar at drive point 5.

Figure 2:
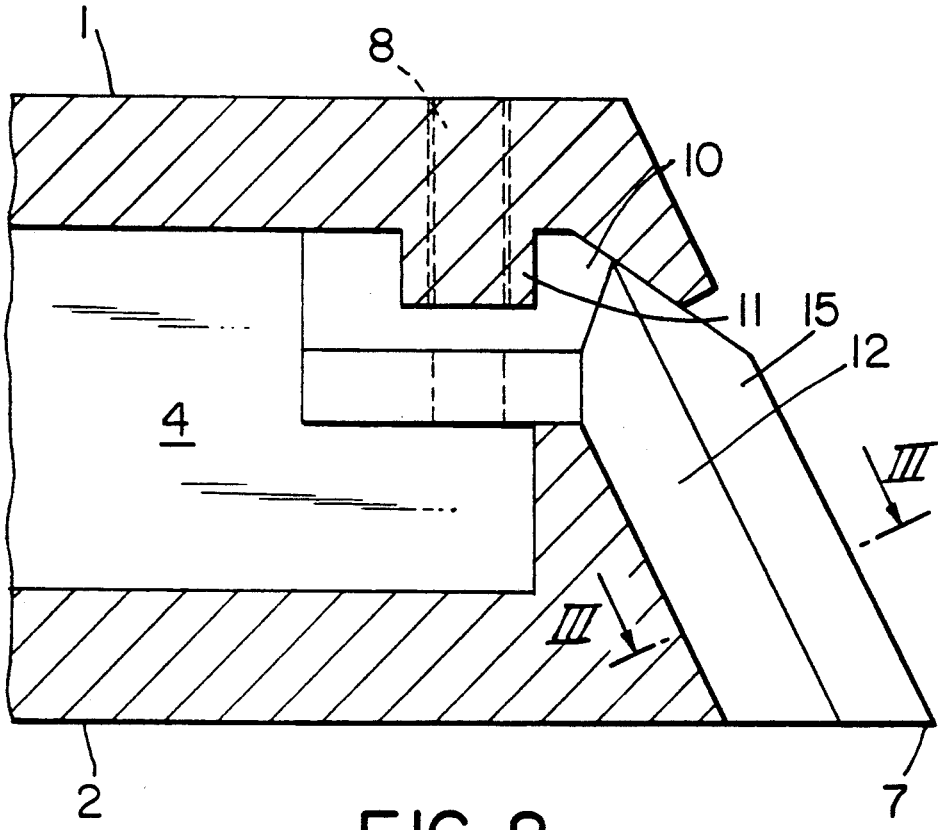
FIG. 2 is a partial longitudinal sectional view of another grate bar in accordance with the present invention.

FIG. 2 illustrates the head part of another grate bar having a replaceable front part 10 disposed between the upper surface 1 and the bottom side or lower surface 2, and which matingly engages in a form-locked or form-fitted manner around a projection 11 on upper surface 1. The front part 10 is loosely held in place by a threaded pin (not shown) inserted through hole 8.

The insertable front part 10 and a parallel front part (not shown) inserted on the other side of the central rib 4 or a front part of an adjacent grate bar, form an air channel 12 on the front edge of the grate bar or bars, respectively, and an air outlet nozzle 15 which permits a stream of air to emerge at an angle $\alpha$, as previously described with respect to the horizontal plane H of the grate.

Figure 3:
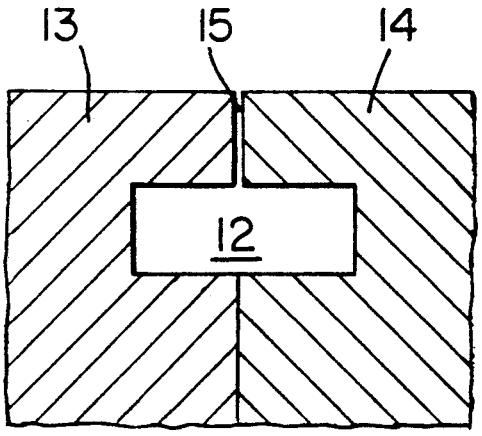
FIG. 3 is a cross sectional view of the air outlet nozzle referenced in FIG. 2.

FIG. 3 shows the above-described arrangement along section line III—III of FIG. 2 with respect to two adjacent grate bars 13 and 14.

Figure 4:
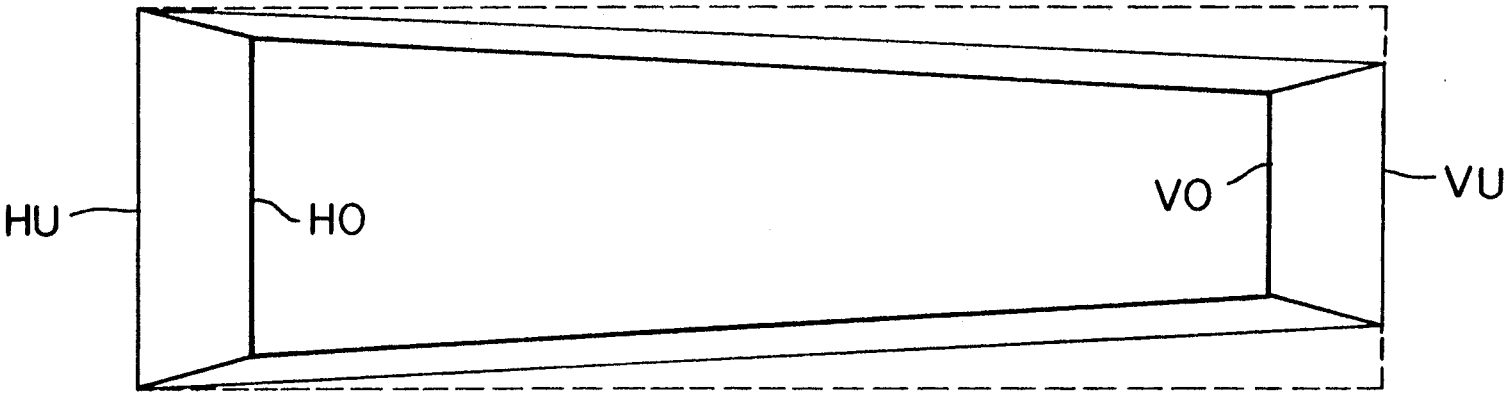
FIG. 4 is a top view of a grate bar.

FIG. 4 diagrammatically illustrates the top view of a grate bar similar to that shown in FIG. 1. HU is the rear lower edge of the grate bar and HO is the rear upper edge of the surface of the grate bar. Similarly, VO is the front edge of the grate bar on its surface and VU is the front edge of the grate bar on its lower surface. In the cold state and in order to accommodate the different thermal expansions of the grate bar during the operation of the furnace, the front edge of the grate bar is made narrower than the rear edge while the upper surface is made narrower than the lower surface. The dashed lines of FIG. 4 illustrate the expansion of the grate bar. As illustrated, the side surfaces have expanded in both a vertical and parallel manner and no longer appear trapezoidal in the transverse direction. Under these circumstances, the grate surface would be flat.

It is understood that the illustration as shown in FIG. 4 is somewhat exaggerated. The actual volume of material removed from the bar to form the trapezoidal shape is a few tenths of a millimeter which can be produced by non-parallel grinding of the surfaces.

Figure 5:
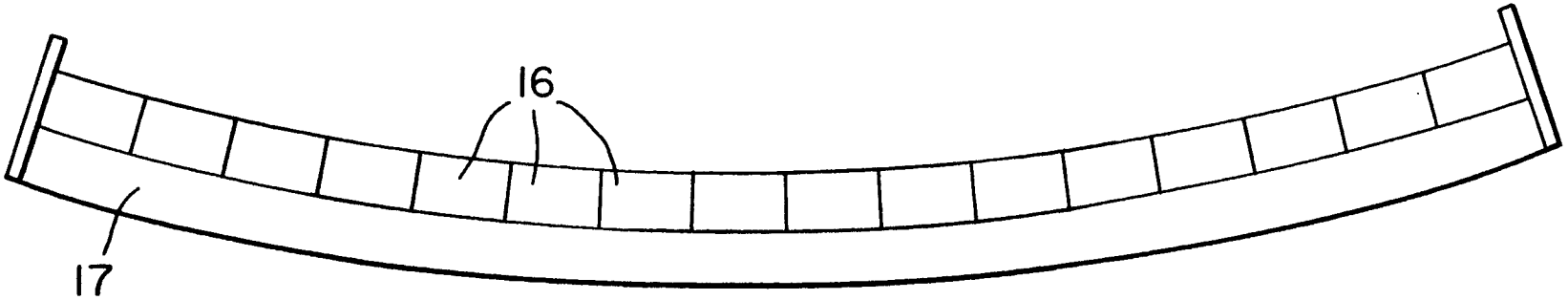
FIG. 5 is a front view of a row of grate bars in a trough-like position.

If the trough position of the grate surface (FIG. 5) is to be retained while under hot operating conditions, then each grate bar 16 must be shaped so that it retains its trapezoidal shape along the transverse direction and the sides of the grate bars remain non-parallel in the vertical direction. The grate-bar support 17 is then also formed in an arcuate shape.

It should be understood that the preferred embodiments and examples described are for illustrative purposes only and are not to be construed as limiting the scope of the present invention which is properly delineated only in the appended claims.

What is claimed is:

1. A grate bar for use in combustion furnaces, such as rubbish incinerators, comprising an elongated hollow box-shaped member having closed uninterrupted upper and lower surfaces and closed uninterrupted side surfaces extending between said upper and lower surfaces, said upper and lower surfaces each having a width and a length, wherein the width of the upper surface is smaller than the width of the lower surface and the length of the upper surface is smaller than the length of the lower surface, such that said hollow box-shaped member has a trapezoidal cross section along a longitudinal direction thereof and a trapezoidal cross section along a direction transverse to said longitudinal direction; a front end and a rear end; an air inlet opening located at said rear end for introducing air into said member; and an air outlet opening configured as a nozzle and located at said front end of said member.

2. The grate bar according to claim 1, additionally comprising a rib disposed within said hollow-box shaped member and extending along the longitudinal direction so as to divide said member into separate portions.

3. The grate bar according to claim 1, wherein said upper and lower surfaces have converging side edges along the longitudinal direction so as to form a trapezoidal shape along the longitudinal direction.

4. The grate bar according to claim 1, wherein said hollow member additionally comprises removable front part disposed at said front end and below said upper surface for preventing foreign matter from entering said hollow member.

5. The grate bar according to claim 1, wherein said hollow box shaped member comprises at least two U-shaped members longitudinally attached to each other so as to form the hollow box shaped member.

6. The grate bar according to claim 1, wherein said hollow box shaped member comprises at least two I-shaped members longitudinally attached to each other so as to form the hollow-box shaped member.

7. A grate for a combustion furnace, particularly for a rubbish incinerator, comprising:

a) a plurality of consecutive rows of grate bars, at least partially overlapping each other so as to form a stepped surface for supporting and moving material to be incinerated in a direction of movement, each grate bar comprising an elongated hollow box-shaped member having closed uninterrupted upper and lower surfaces and closed uninterrupted side surfaces extending between said upper and lower surfaces, said upper and lower surfaces each having a width and a length, wherein the width of the upper surface is smaller than the width of the lower surface and the length of the upper surface is smaller than the length of the lower surface, such that said hollow box-shaped member has a trapezoidal cross section along a longitudinal direction thereof and a trapezoidal cross section along a direction transverse to said longitudinal direction, a front end and a rear end, an air inlet opening located at said rear end for introducing air into said member, and an air outlet opening configured as a nozzle and located at said front end of said member;

b) at least one grate bar support for supporting at least each second one of said plurality of rows of grate bars;

c) said air outlet opening of each grate bar being directly downwardly away from a horizontal plane.

8. The grate bar according to claim 7, wherein said grate bar support extends perpendicularly to the direction of movement in an arcuate shape for forming a trough-like grate surface.

9. The grate according to claim 7, wherein said grate comprises a plurality of overlapping alternately stationary and movable rows of grate bars forming steps having a length in the direction of movement of the material to be burned; said movable rows of grate bars being variably and reciprocatingly movable by a distance corresponding, at a maximum, to the length of the steps formed by said rows of grate bars.

* * * * *